US009509069B2

(12) United States Patent
Komiyama et al.

(10) Patent No.: US 9,509,069 B2
(45) Date of Patent: Nov. 29, 2016

(54) ELECTRICAL CONNECTOR AND FEMALE TERMINAL

(71) Applicants: Tyco Electronics Japan G.K., Kanagawa (JP); Toyota Jidosha Kabushiki Kaisha, Aichi-ken (JP)

(72) Inventors: Ryuichi Komiyama, Kanagawa (JP); Tetsuro Akiguchi, Kanagawa (JP); Yoshifumi Suemitsu, Kanagawa (JP); Kazuhiko Ueda, Aichi-ken (JP); Natsuki Nozawa, Aichi-ken (JP); Hitoshi Ozaki, Aichi-ken (JP); Masao Noguchi, Aichi-ken (JP); Arata Harada, Aichi-ken (JP)

(73) Assignees: Tyco Electronics Japan G.K., Kanagawa-ken (JP); Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/579,051

(22) Filed: Dec. 22, 2014

(65) Prior Publication Data

US 2015/0111419 A1 Apr. 23, 2015

Related U.S. Application Data

(63) Continuation of application No. PCT/JP2013/003483, filed on Jun. 3, 2013.

(30) Foreign Application Priority Data

Jun. 28, 2012 (JP) ..... 2012-145261

(51) Int. Cl.
*H01R 11/01* (2006.01)
*H01R 13/11* (2006.01)
(Continued)

(52) U.S. Cl.
CPC ..... *H01R 11/01* (2013.01); *H01R 12/91* (2013.01); *H01R 13/11* (2013.01);
(Continued)

(58) Field of Classification Search
USPC ..... 439/510, 572, 121, 627, 813, 816; 337/198
See application file for complete search history.

(56) References Cited

U.S. PATENT DOCUMENTS 3,980,388 A * 9/1976 Nailor, III ..... 439/752
4,738,631 A 4/1988 Takahashi et al.
(Continued)

FOREIGN PATENT DOCUMENTS

JP 57158969 A 9/1982
JP 2000091029 A 3/2000
(Continued)

OTHER PUBLICATIONS

European Search Report, dated Dec. 15, 2015, 7 pages.
(Continued)

*Primary Examiner* — Alexander Gilman
(74) *Attorney, Agent, or Firm* — Barley Snyder

(57) ABSTRACT

An electrical connector is disclosed having a housing and a female terminal. The housing has an assembly receiving space. The female terminal is positioned in the assembly receiving space and has a first female terminal, a second female terminal, and an elastic connecting spring. The first female terminal has a first contact receiving space. The second female terminal has a second contact receiving space and is independently displaceable relative to the first female terminal along a longitudinal axis. The elastic connecting spring connects the first female terminal to the second female terminal.

16 Claims, 4 Drawing Sheets

(51) Int. Cl.

| | |
|---|---|
| ***H01R 13/631*** | (2006.01) |
| ***H01R 12/91*** | (2011.01) |
| *H01R 13/627* | (2006.01) |
| *H01R 13/502* | (2006.01) |
| *H01R 13/533* | (2006.01) |

(52) U.S. Cl.
CPC ..... *H01R 13/6315* (2013.01); *H01R 13/502* (2013.01); *H01R 13/533* (2013.01); *H01R 13/6272* (2013.01); *H01R 2201/26* (2013.01)

(56) References Cited

U.S. PATENT DOCUMENTS

| | | | | |
|---|---|---|---|---|
| 5,398,015 | A * | 3/1995 | Kudo et al. | 337/255 |
| 5,781,094 | A * | 7/1998 | Nakamura et al. | 337/238 |
| 5,883,561 | A * | 3/1999 | Nakamura et al. | 337/198 |
| 6,144,283 | A * | 11/2000 | Matsumura | 337/198 |
| 6,529,113 | B2 * | 3/2003 | Endo et al. | 337/198 |
| 7,458,862 | B2 * | 12/2008 | Zhao et al. | 439/840 |
| 7,775,810 | B2 * | 8/2010 | Lawrence et al. | 439/121 |
| 8,100,723 | B2 * | 1/2012 | Vetter et al. | 439/627 |
| 8,287,313 | B2 * | 10/2012 | Kwon et al. | 439/627 |
| 8,339,235 | B2 * | 12/2012 | Beckert et al. | 337/198 |
| 8,523,605 | B2 * | 9/2013 | Kobayashi | 439/510 |
| 8,708,735 | B2 * | 4/2014 | Aime et al. | 439/510 |
| 8,992,268 | B2 * | 3/2015 | Casses et al. | 439/816 |
| 9,033,748 | B2 * | 5/2015 | Ramey et al. | 439/813 |

FOREIGN PATENT DOCUMENTS

| | | |
|---|---|---|
| JP | 2003323924 A | 11/2003 |
| JP | 2008243538 | 10/2008 |

OTHER PUBLICATIONS

Abstract of JP2008243538, dated Oct. 9, 2008, 1 page.

* cited by examiner

ELECTRICAL CONNECTOR AND FEMALE TERMINAL

CROSS-REFERENCE TO RELATED APPLICATION

This application is a continuation of PCT International Application No. PCT/JP2013/003483 filed Jun. 3, 2013 which claims priority under 35 U.S.C. §119 to Japanese Patent Application No. 2012-145261, dated Jun. 28, 2012.

FIELD OF THE INVENTION

The present invention generally relates to an electrical connector, and more specifically, to an electrical connector having a female terminal.

BACKGROUND

An electrical connector ("connector") is used for various applications, depending on which, the connector may be subjected to substantial vibrations. In a conventional connector, a male connector having a male terminal and a female connector having a female terminal, are brought into electrical contact when the male and female terminals are electrically mated together. However, when the connector is subjected to vibration, contact between the male terminal and the female terminal is difficult to maintain, and the reliability of the connector is thus impaired.

An example of conventional vibration resistant connectors can be seen in Japanese Patent Nos. 2000-91029 ('029) and 2003-323924 ('924). In '029, a connector is disclosed that connects a male connector and a female connector to each other, even when the male connector and the female connector do not properly face each other upon assembling an instrument panel module. Additionally, the connector in '029 prevents deformation or breakage on the occurrence of displacement or vibration between modules after both the connectors are connected.

In '924, a connector is disclosed having a structure that reduces the transmission of vibration or shock between mated connectors, thus maintaining a secure contact between the male and female connectors.

In conventional connectors connecting a plurality of female terminals retained by a single housing and a plurality of male terminals connected to a single member, for example, a circuit board, when this circuit board is vibrated by an external force, both of the male terminals and the female connector including the female terminals vibrate in synchronization with the circuit board. Therefore, a relative positional relationship between the male terminals and the female terminals, namely, a contact relationship, can be maintained in an initial contact state, or, even if the relationship cannot be maintained, the relative displacement of the terminals with respect to each other, is inconsiderable.

However, such contact stability is lacking when the male terminals are connected to different devices, an example being when male terminals MA connected to a circuit board A and male terminals MB connected to a circuit board B are in contact with a plurality of female terminals retained by a single housing. In this case, the respective vibration patterns of the circuit board A and the circuit board B may be different from each other. It should be noted that the vibration pattern defined herein includes at least a vibration period and/or amplitude, such that a displacement of the male terminal MA due to this vibration and a displacement of the male terminal MB due to this vibration consequently differ from each other. Based on this difference, a relative positional relationship between the male terminal MA and a female terminal FA and a relative positional relationship between the male terminal MB and a female terminal FB must be present in order to maintain contact stability.

There is a need for an electrical connector a female terminal capable of keeping a relative contact positional relationship with each male terminal, even when the female terminal is in contact with the male terminal connected to a circuit board or another member having a different vibration pattern.

SUMMARY

An electrical connector has a housing and a female terminal. The housing has an assembly receiving space. The female terminal is positioned in the assembly receiving space and has a first female terminal, a second female terminal, and an elastic connecting spring. The first female terminal has a first contact receiving space. The second female terminal has a second contact receiving space and is independently displaceable relative to the first female terminal along a longitudinal axis. The elastic connecting spring connects the first female terminal to the second female terminal.

BRIEF DESCRIPTION OF THE DRAWINGS

The invention will now be described by way of example, with reference to the accompanying Figures, of which.

DETAILED DESCRIPTION OF THE EMBODIMENT(S)

The present invention will be described in detail below on the basis of an electrical connector 1 shown in FIGS. 1 to 4 attached hereto.

Figure 2:
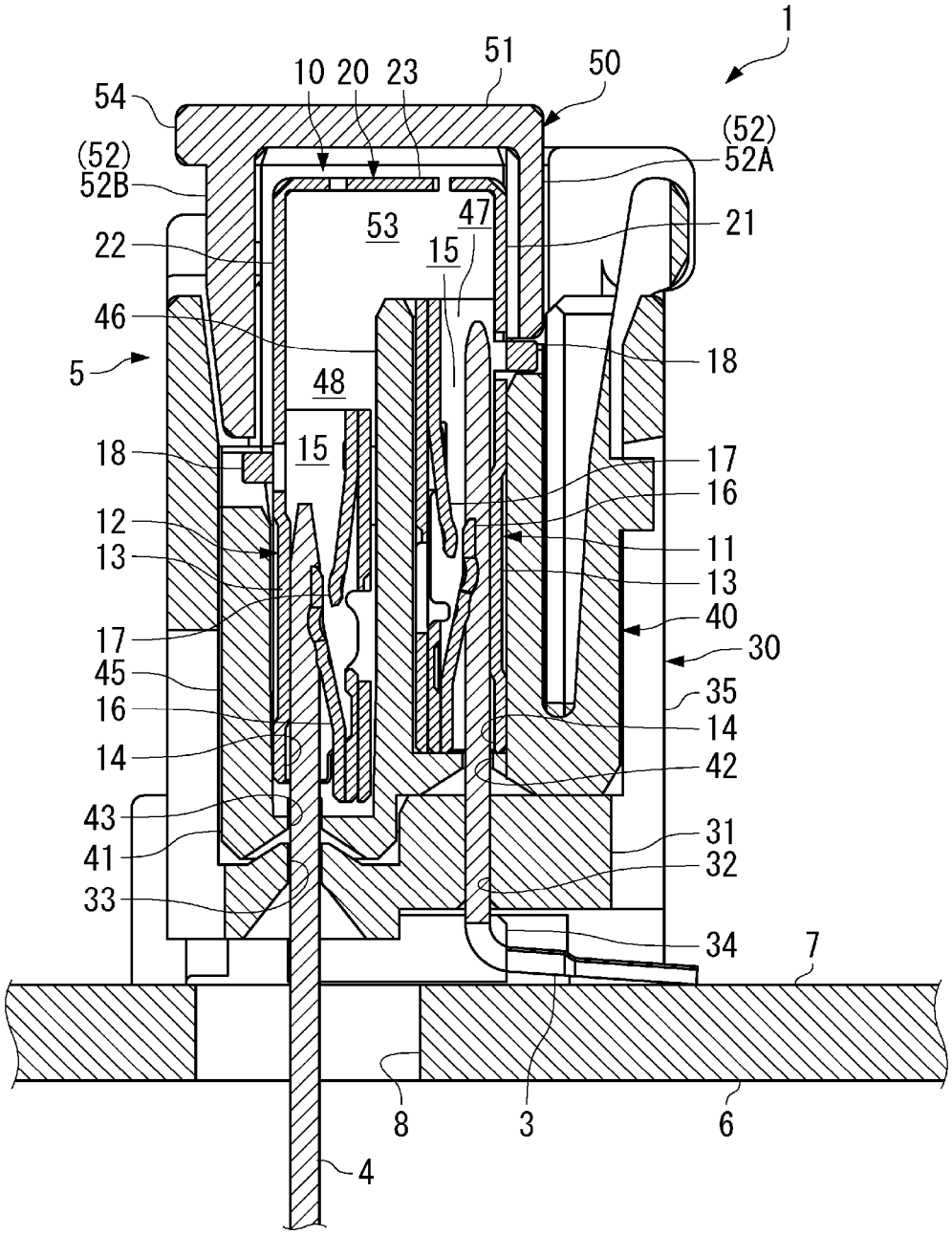
FIG. 2 is a longitudinal sectional view showing an electrical connector according to this embodiment, with respective components attached.
Figure 3:
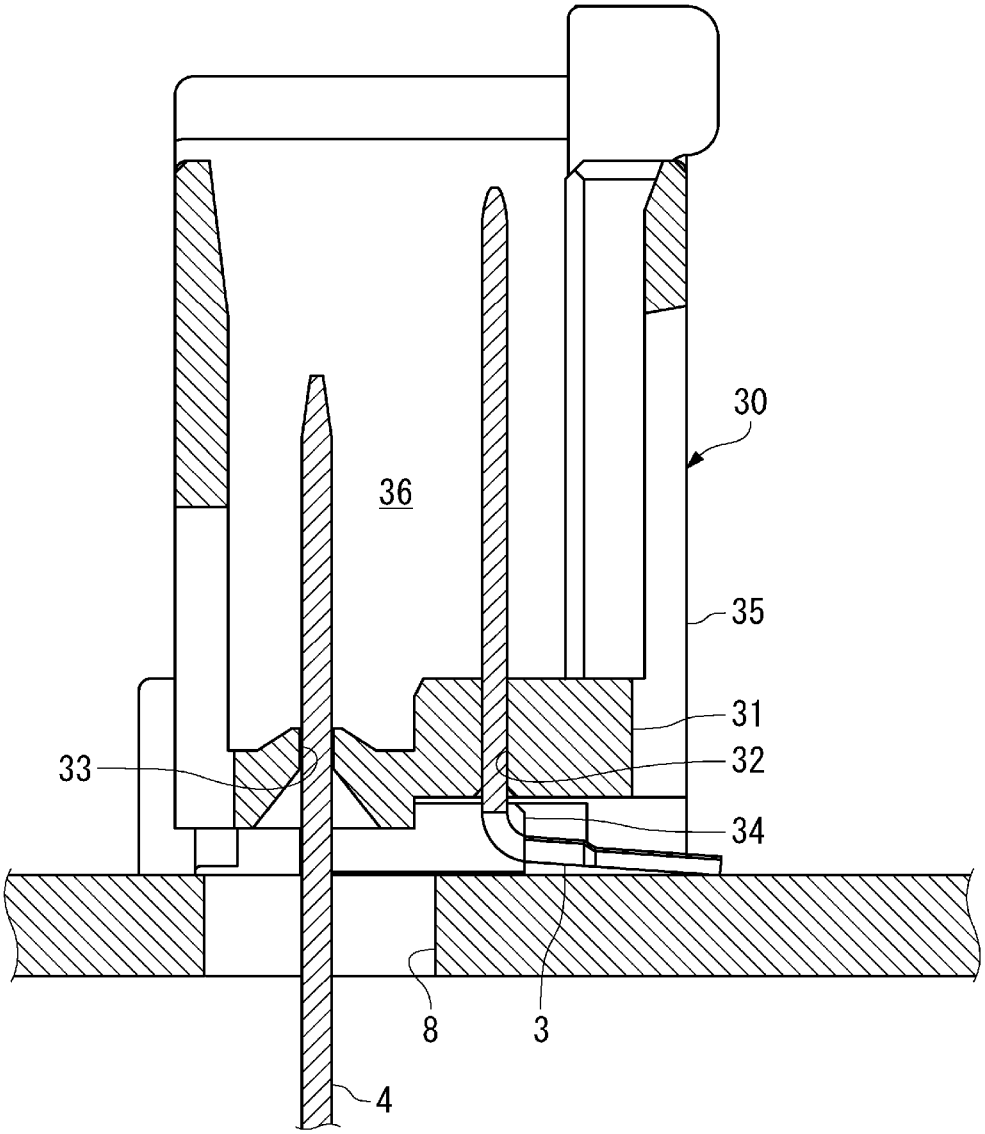
FIG. 3 is a longitudinal sectional view showing an electrical connector according to this embodiment, with the female terminal, a second housing member, and a third housing member detached.
Figure 4:
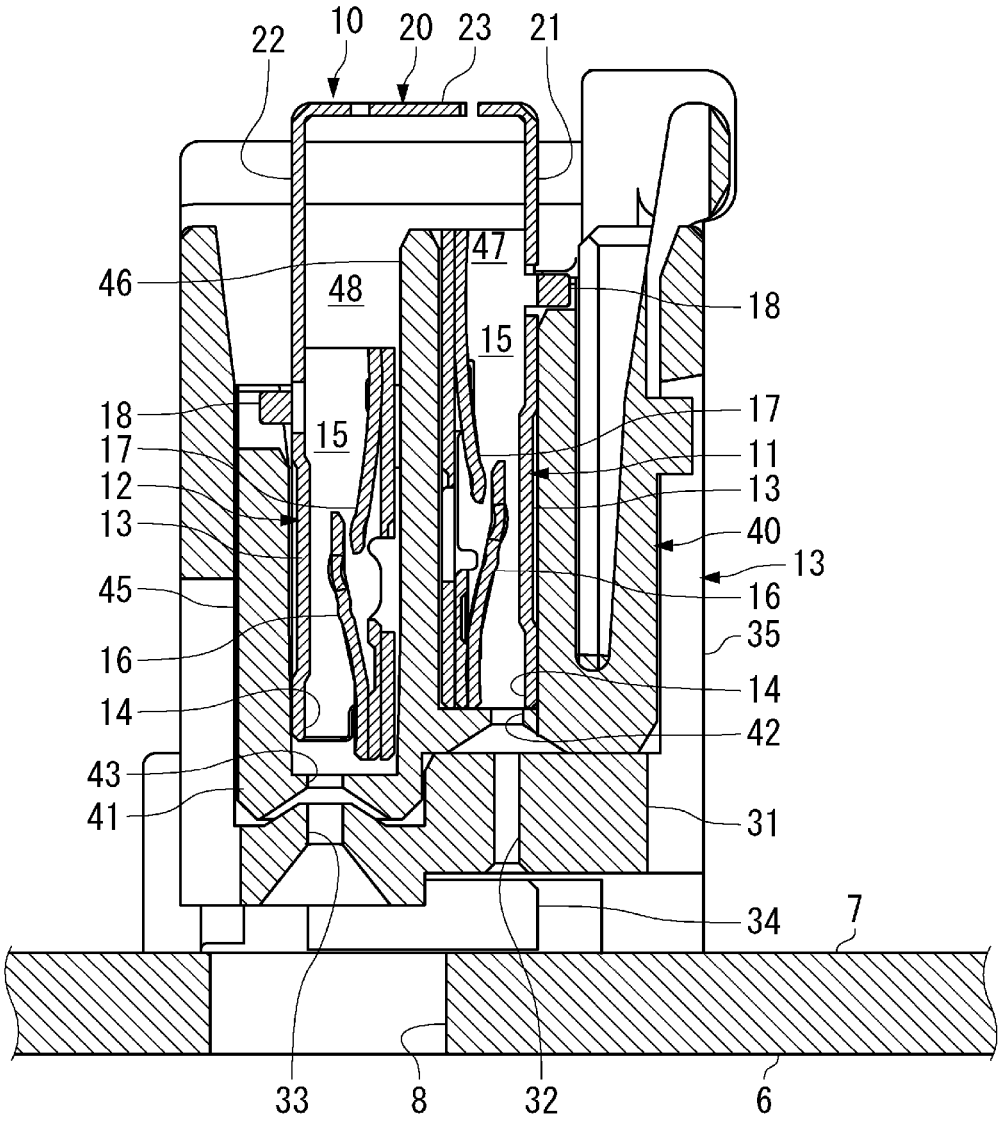
FIG. 4 is a longitudinal sectional view showing an electrical connector according to this embodiment, with male terminals and the third housing member detached.

The electrical connector 1 according to embodiments of FIGS. 2-4, includes a female terminal 10 and a housing 5. The female terminal 10 is positioned in the housing 5, and the housing 5 is connected to a circuit board 6. The female terminal 10 makes electrical contact with a first male contact 3 and a second male contact 3.

The first male contact 3 is connected to the circuit board 6, and the second male contact 3 is connected to a device (not shown) disposed below the circuit board 6 in FIGS. 2 to 4. Therefore, the first male contact 3 and the second male contact 3 have different vibration patterns. In order to absorb the different vibration patterns, the electrical connector 1 has a configuration whereby the female terminal 10 is supported by a supporting structure defined by the housing 5.

Figure 1:
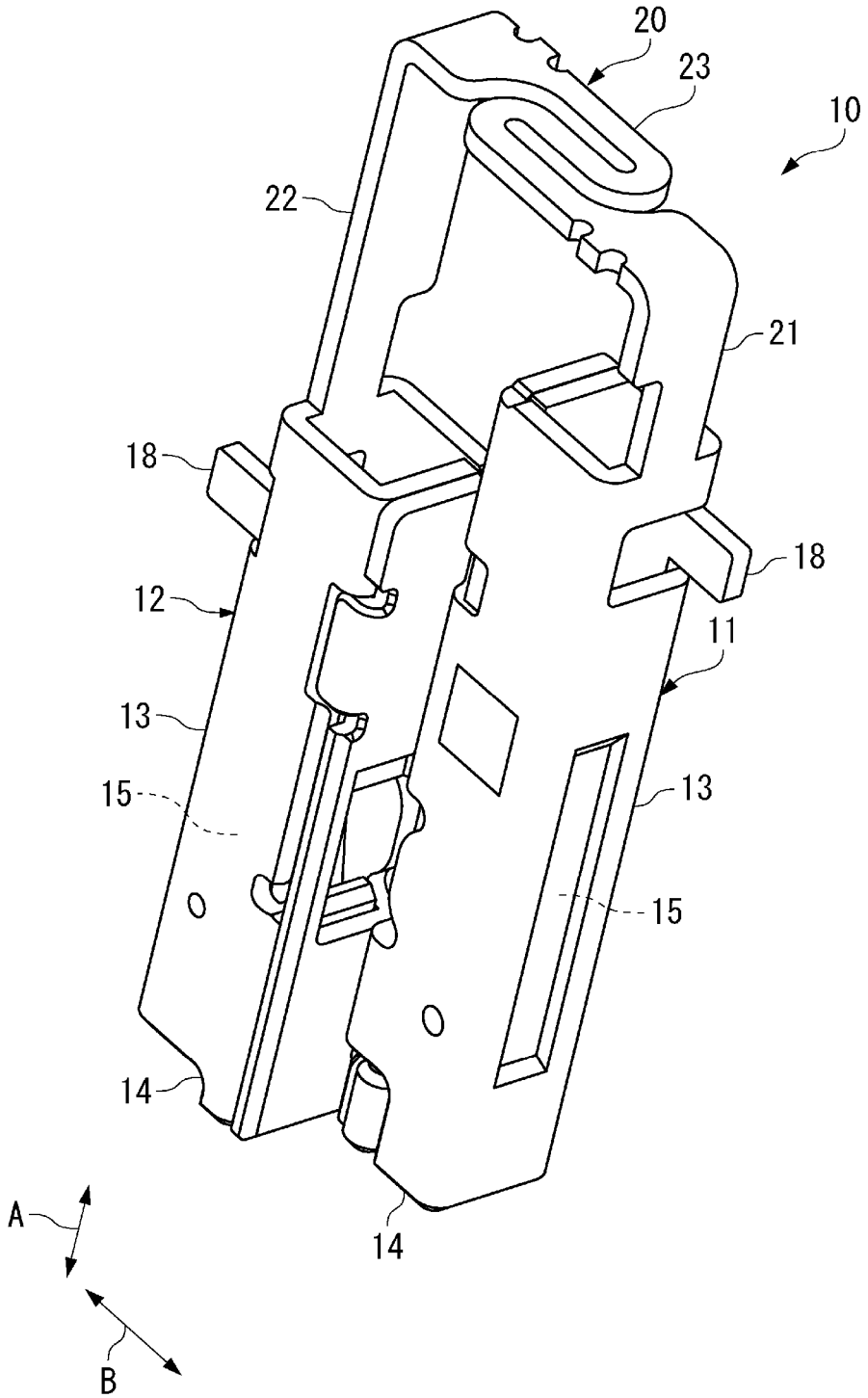
FIG. 1 is a perspective view showing a female terminal according to an embodiment of the present invention.

The female terminal 10, as shown in the embodiment of FIG. 1, includes a first female terminal 11, a second female terminal 12, and a connecting spring 20 connecting the first female terminal 11 and the second female terminal 12. In the female terminal 10, the first female terminal 11, the second female terminal 12, and the connecting spring 20 are integrally formed by stamping and bending a highly-conductive metal sheet, such as copper or copper alloy. The first female terminal 11 and the second female terminal 12 have approximately the same shape and dimensions. The first and second female terminals 11,12 are connected through the connecting spring 20 such that the positions of the first female terminal 11 and the second female terminal 12, in longitudinal axis A, hereinafter referred to as the longitudinal axis A, of the first male terminals 3, 4, are offset and out of alignment. As described below, since the first female terminal 11 and the second female terminal 12 are connected through the connecting spring 20, the first female terminal 11 and the second female terminal 12 can be independently displaced.

The first female terminal 11 includes a box-like terminal body 13 having a contact receiving opening 14 positioned on a receiving end of the terminal body 13, and a contact receiving space 15 extending inwards from the contact receiving opening 14. The first male contact 3 is inserted through the contact receiving opening 14, into the contact receiving space 15. An opposite second end of the terminal body 13 is connected integrally with the connecting spring 20. In the embodiments of FIGS. 2 and 4, a first leaf 16 and a second leaf 17 are positioned in the contact receiving space 15, and press the inserted first male contact 3 against an inner wall of the terminal body 13. It should be noted that, in FIG. 2, the first leaf 16 is in a relaxed position of an unloaded state, wherein the first male contact 3 is not inserted, and therefore overlaps with the first male contact 3.

A locking projection 18 is formed on an outer wall of the terminal body 13. With the female terminal 10 attached to the housing 5, the locking projection 18 engages the housing 5 to position and retain the female terminal 10 in the housing 5.

Since the second female terminal 12 is substantially the same as the first female terminal 11, the same components as those of the first female terminal 11 are denoted by the same reference numerals. Therefore, the description of the second female terminal 12 is omitted. As described above, however, the first female terminal 11 and the second female terminal 12 are positions of the first female terminal 11 and the second female terminal 12 along the longitudinal axis A are offset, being out of alignment. Specifically, when the female terminal 10 is attached to the housing 5, the second female terminal 12 is positioned proximate to the circuit board 6 than the first female terminal 11, which is distal to the circuit board 6. In addition, the first female terminal 11 and the second female terminal 12 are positioned so as to face in opposite directions, such that their respective locking projections 18 face outward and their respective first leaf 16 and second leaf 17 face each other inside the contact receiving space 15. Further, the locking projection 18 of the second female terminal 12, as described below, functions when the second male contact 3 and the second female terminal 12 are mated with each other.

The connecting spring 20 includes a pair of first and second arms 21, 22 and a connecting member 23 connecting the distal ends of the arms 21, 22 to each other. The connecting spring 20 is elastically deformable by a weak force so that the first female terminal 11 and the second female terminal 12 can be independently displaced when the electrical connector 1 is subjected to vibration.

The first arm 21 is connected integrally with the second end of the first female terminal 11, and extends along the longitudinal axis A. Similarly, the second arm 22 is integrally connected to the second end of the second female terminal 12, and extends along the longitudinal axis A. In an embodiment, the length of extension of the second arm 22 is longer than that of the first arm 21, such that the positions of the first female terminal 11 to that of the second female terminal 12, along the longitudinal axis A, are offset. Since the arms 21, 22 are formed along the longitudinal axis A, the arms 21, 22 may deflect in widthwise direction B, orthogonally to the longitudinal axis A (See FIG. 1). The arms 21, 22 are narrowed at their respective terminal connecting ends, where they are connected to the first female terminal 11 and the second female terminal 12, so that the arms 21,22 can deflect easily when the electrical connector 1 is subjected to vibration.

The connecting member 23 is formed in an approximate S-shape to make the spring constant small, and is capable of deflecting primarily along the longitudinal axis A. When the female terminal 10 is attached to the housing 5, the first female terminal 11 is fixed to and restrained by the housing 5, but the second female terminal 12 is not restrained but is free from the housing 5. Thus, the connecting member 23 functions as a cantilever, whose fixed end is an end of the connecting member 23 connected to the first arm 21.

In the embodiment of FIG. 2, the first and second male contacts 3, 4, are pin-type contacts having a tab-like shape. The first and second males contacts 3,4 are mated with the first female terminal 11 and the second female terminal 12, respectively.

The first male contact 3 has an approximate L-shape, and is attached to a surface 7 of the circuit board 6. In an embodiment, the first male contact 3 is attached by soldering (not shown), although one of ordinary skill in the art would appreciate that other known attachment mechanisms may also be used. The second male contact 3 has an approximate straight shape, and is connected to the electrical device (not shown). In an embodiment, the electrical device does not have a mechanically restraining relationship with the circuit board 6. Therefore, when the electrical device and the circuit board 6 vibrate, the electrical device and the circuit board 6 have different vibration patterns, and accordingly the first male contact 3 and the second male contact 3 also have different vibration patterns.

The first male contact 3 is brought into electrical contact with the first female terminal 11 by inserting a mating end of the first male contact 3 into the contact receiving space 15 of the first female terminal 11. The first male contact 3 subjected to a pressing force from the first leaf 16 and second leaf 17, which elastically deform to press the first male contact 3 against the inner wall of the terminal body 13 so that the first female terminal 11 and the first male contact 3 are maintained in electrical contact with each other.

The second male contact 3, similarly, is brought into electrical contact with the second female terminal 12 by inserting a mating end of the second male contact 3 into the contact receiving space 15 of the second female terminal 12. The second male contact 4 is subjected to a pressing force from the first leaf 16 and the second leaf 17, which elastically deform to press the second male contact 4 against the inner wall of the terminal body 13 so as to establish and maintain electrical contact with the second female terminal 12. A through-hole 8 is formed in the circuit board 6, and extends from a front face and a back face thereof, and the second male contact 3 is positioned into the contact receiving space 15 through the through-hole 8.

Contact between the first female terminal 11 and the first male contact 3 needs be constant while the electrical connector 1 is being used in order to stably maintain electrical connectivity therebetween. If the relative positions of the first femal terminal 11 and the first male contact 3 are displaced, electrical contact can no longer be maintained because of an insufficient contact load, often due to wearing of contact surfaces of the first female terminal 11 and the first male contact 3. Similarly, such electrical connectivity applies to the combination of the second male contact 4 and the second female terminal 12.

The housing 5, as shown in the embodiments of FIGS. 2 and 3, is connected to the circuit board 6, and houses the female terminal 10 therein.

The housing 5 includes a first housing member 30, a second housing member 40, and a third housing member 50 mounted in this order from the circuit board 6 side. In an embodiment, each housing members 30,40,50 are produced by injection molding of insulating resin.

The first housing member 30, as shown in the embodiment of FIGS. 2 to 4, generally has the shape of an inverted cap, and includes a contact retaining first base 31 facing the circuit board 6, a first side wall 35 extending upward from a peripheral edge of the contact retaining first base 31, and an assembly receiving space 36 (FIG. 3) defined by the contact retaining first base 31 and the first side wall 35.

A first through-hole 32, into which the first male contact 3 is inserted, and a second through-hole 33, into which the second male contact 3 is inserted, are formed in the contact retaining first base 31. The first through-hole 32 has opening dimensions set so that the first male contact 3 is press-fitted therein. The second through-hole 33 has an opening diameter set so that a clearance exists between the second through-hole 33 and the second male contact 3 which is inserted through the hole-hole 33. It should be noted that insertion into a through-hole having a clearance is hereinafter referred to as loosely fitting. The contact retaining first base 31 has a first portion, which includes the first through-hole 32, formed thicker than a second portion, which includes the second through-hole 33, such that the first male contact 3 is retained in the contact retaining first base 31 with a sufficient force. The difference in thicknesses between the first and second portions corresponds to the amount of displacement between the first female terminal 11 and the second female terminal 12.

A foot 34 for fixing the first housing member 30 to the surface 7 of the circuit board 6 is positioned on a bottom facing surface of the contact retaining first base 31. In an embodiment, the first housing member 30 is connected to the circuit board 6 by soldering the foot 34 to the surface 7.

The first male contact 3 and the second male contact 4, passing through the contact retaining first base 31, and the female terminals 10 11, mated with these male contacts 3,4, are positioned in the assembly receiving space 36. Additionally, the second housing member 40 and third housing member 50 are also positioned in the assembly receiving space 36, and are connected to the first housing member 30.

The second housing member 40, as shown in an embodiment of FIGS. 2 and 4, includes a second base 41 facing the contact retaining first base 31 of the first housing member 30, a second side wall 45 extending upward from the periphery of the second base 41, and a partition 46 dividing a region enclosed by the second base 41 and the second side wall 45 into a first terminal receiving space 47 and a second terminal receiving space 48.

A third through-hole 42, through which the first male contact 3 is inserted, and a fourth through-hole 43, through which the second male contact 3 is inserted, are formed in the second base 41. The first male contact 3 is loosely fitted in the third through-hole 42, and the second male contact 3 is positioned in the fourth through-hole 43.

The first female terminal 11 is positioned in the first terminal receiving space 47, and the second female terminal 12 is positioned in the second terminal receiving space 48.

The first female terminal 11 is retained in the second housing member 40 by positioning a contact receiving end, in which the contact receiving opening 14 is formed, into contact with the second base 41, and inserting the locking projection 18, positioned on an opposite upper end, into a locking projection receiving space (not labeled) of the second side wall 45.

A contact receiving end of the second female terminal 12 is positioned proximate to, but spaced a distance away from the second base 41, with a clearance being provided between the second female terminal 12 and the second side wall 45 and the partition 46. A gap (shown, but not labeled in FIG. 2) is formed between the locking projection 18 of the second female terminal 12 and an upper end of the second side wall 45 in contact with the second terminal receiving space 48. Therefore, the second female terminal 12 is suspended from the connecting spring 20 inside the second terminal receiving space 48.

The third housing member 50, as shown in the embodiment of FIG. 2, generally has the shape of a cap, and is connected to the first housing member 30 so as to cover upper portions of the first housing member 30 and the second housing member 40, including the female terminal 10, the first male contact 3, and the second male contact 4. Although not illustrated, one of ordinary skill in the art would appreciate that the third housing member 50 is prevented from falling out of the first housing member 30 by engaging a locking piece formed on the first housing member 30, and a locking piece formed on the third housing member 50, with each other.

The third housing member 50 includes a ceiling 51, a pair of side walls 52 comprising a third sidewall 52A and a fourth sidewall 52B extending from the periphery of the ceiling 51, and a connecting spring receiving recess 53 defined by the ceiling 51 and the side walls 52.

When the third housing member 50 is connected, a lower end of the third side wall 52A is in contact with the locking projection 18 of the first female terminal 11. Therefore, the first female terminal 11 is connected to the housing 5 by engaging the locking projection 18 between the second side wall 45 of the second housing member 40 and the third side wall 52A of the third housing member 50 from above and below. In the housing 5, since the first housing member 30 is connected to the surface 7 of the circuit board 6, the first female terminal 11 is indirectly connected to the circuit board 6.

When the third housing member 50 connected, a gap is provided between a lower end of the fourth side wall 52B and the locking projection 18 of the second female terminal 12. Therefore, the locking projection 18 of the second female terminal 12 is not under mechanical restraint.

The connecting spring 20 is positioned in the connecting spring receiving recess 53, and the ceiling 51 and the third side wall 52 are positioned along the connecting spring 20 at a small distance with the connecting spring 20. A pressing projection 54 projecting horizontally is disposed on the ceiling 51, intersecting the fourth side wall 52. The pressing projection 54 is used when the first male contact 3 and the second female terminal 12 are mated.

When the pressing projection 54 is pressed downward, as the ceiling 51 deflects counterclockwise, the fourth side wall 52 is displaced downward and brought into contact with the locking projection 18 of the second female terminal 12. Then, when the locking projection 18 is further pressed downward, the fourth side wall 52 is displaced until the locking projection 18 contacts the upper end of the second side wall 45. In this manner, with the second female terminal 12 temporarily restrained, mating of the second male contact 3 and the second female terminal 12 is performed. After mating, pressing the pressing projection 54 is stopped so that the second female terminal 12 returns to the state of being not mechanically restrained.

The functions and advantageous effects of the electrical connector 1 thus configured will be described below.

While the first female terminal 11 is connected to the housing 5, the second female terminal 12 is suspended from the connecting spring 20. That is, even when the first female terminal 11 is subjected to vibration and displaced with the housing 5, the second female terminal 12 is not necessarily displaced following the vibration of the housing 5. However, in this embodiment, since a force F2 of insertion and extraction between the second female terminal 12 and the second male contact 3 exceeds a load F1 required for the connecting spring 20 to elastically deform, the second female terminal 12 and the second male contact 3 can be displaced while maintaining the position of contact. Thus, since the first female terminal 11 and the second female terminal 12 can be displaced independently of each other, even when the circuit board 6 and the electronic device (not shown) have different vibration patterns, both of the female terminals 11,12 can vibrate in synchronization with the respective vibration patterns of the circuit board 6 and the electronic device, keeping the position of contact with the male terminals 3,4. Therefore, even when being in contact with male terminals 3,4 connected to devices having different vibration patterns, the electrical connector 1 can stably maintain electrical contact between the male terminals 3,4 and the female terminals 11,12.

In the electrical connector 1, the positions of the first female terminal 11 and the second female terminal 12 are offset, so as to be out of alignment along the longitudinal axis.

This causes a difference between the timing when the first male contact 3 is mated with the first female terminal 11 and the timing when the second male contact 3 is mated with the second female terminal 12. Therefore, as compared with the case where the first female terminal 11 and the second female terminal 12 are disposed in the same positions in the directions of insertion and extraction, a mating force required at the same point of time can be reduced.

In addition, since the positions of the first female terminal 11 and the second female terminal 12 along the longitudinal axis are offset, the first male contact 3 and the second male contact 3, each having different lengths, can be connected.

Further, since in the second female terminal 12 proximate to the circuit board 6, a distance to the second end of the second female terminal 12 can be increased, if necessary, so as to be longer than that to a point of contact between the first leaf 16 and the second male contact 3, thus ensuring effective contact lengths of the second male contact 3 and the second female terminal 12.

Although suspended while the electrical connector 1 is being in operation as a connector, the second female terminal 12 can be temporarily mechanically restrained by operating the pressing projection 54 at the time of mating with the second male contact 3, so that mating the second female terminal 12 and the second male contact 3 with each other can be reliably performed.

The present invention has been described above on the basis of the embodiment, but one of ordinary skill in the art would appreciate that the present invention is not limited to the above embodiments.

For example, the above embodiments of the connecting spring 20 are exemplary, and the connecting spring 20 can have other shapes or dimensions as long as the advantageous effects described above can be achieved. In other embodiments, the connecting member 23 can have a straight shape, and the lengths of the pair of arms 21, 22 can be equal. In these embodiments, the positions of the first female terminal 11 and the second female terminal 12 along the longitudinal axis are substantially equal with each other.

In the above embodiment, the first female terminal 11 and the second female terminal 12 have the same design, but in an embodiment the two female terminals 11,12 having different designs.

In the above embodiments, an example of connecting two female terminals via the connecting spring 20 is shown, but more than two female terminals can be connected via a spring. In this case, assuming that there are one or a plurality of female terminals belonging to a group $\alpha$ and one or a plurality of female terminals belonging to a group $\beta$, and that the group $\alpha$ and the group $\beta$ have different vibration patterns, one of the group $\alpha$ and the group $\beta$ is connected to the housing, and the other of the group $\alpha$ and the group $\beta$ is not restrained by the housing.

Furthermore, in the above embodiment, a box-type female terminal and a tab-type male terminal are shown by way of example, but the present invention is applicable to other types of female terminals and male terminals.

In addition, as long as not departing from the spirit of the present invention, the configurations described in the above embodiment can be selectively adopted or removed or, if necessary, changed to other configurations.

What is claimed is:

1. An electrical connector comprising:

a housing having an assembly receiving space; and a female terminal positioned in the assembly receiving space and having:

a first female terminal fixed to the housing having a first contact receiving space, a second female terminal having a second contact receiving space and being independently displaceable in the assembly receiving space relative to the first female terminal and housing along a longitudinal axis, and an elastic connecting spring having an approximate S-shape connecting the first female terminal to the second female terminal.

2. The electrical connector according to claim 1, wherein the elastic connecting spring is elastically deformed by a load smaller than a force of insertion and extraction between the second female terminal and a second male contact.

3. The electrical connector according to claim 1, wherein positions of the first female terminal and the second female terminal are offset, so as to be out of alignment along the longitudinal axis.

4. The electrical connector of claim 2, wherein a first male contact is inserted into the first contact receiving space.

5. The electrical connector according to claim 4, wherein the first male contact and the second male contact have different vibration patterns.

6. A female terminal used in an electrical connector, comprising:

a first female terminal having a first contact receiving space;

a second female terminal having a second contact receiving space and positioned offset with respect to the first female terminal so as to be out of alignment along the longitudinal axis, the second female terminal being independently displaceable along a longitudinal axis, relative to the first female terminal; and an elastic connecting spring having an approximate S-shape connecting the first female terminal to the second female terminal.

7. The female terminal according to claim 6, wherein the first female terminal is fixed to an electrical connector housing.

8. The female terminal according to claim 7, wherein the second female terminal is displaceable with respect to the first female terminal portion.

9. The female terminal according to claim 6, wherein the elastic connecting spring is elastically deformed by a load smaller than a force of insertion and extraction between the first female terminal and the male terminal.

10. The female terminal according to claim 6, wherein a first male contact is positioned in the first contact receiving space and a second male contact is positioned in the second contact receiving space.

11. The female terminal according to claim 10, wherein the first male terminal exhibits vibration patterns different from the second male terminal.

12. The female terminal according to claim 6, wherein the elastic connecting spring further comprises a first arm positioned on a proximate end and a second arm positioned on a distal end.

13. The female terminal according to claim 12, wherein the first and second arms extend approximately parallel along the longitudinal axis.

14. The female terminal according to claim 12, wherein the first arm is integrally connected to the first female terminal and the second arm is integrally connected to the second female terminal.

15. The female terminal according to claim 12, wherein a length of the second arm is greater than a length of the first arm.

16. The female terminal according to claim 12, wherein the elastic connecting spring is cantilevered, with the first arm and the proximate end of the elastic connecting spring being a fixed end of the cantilever, and the second arm and the distal end of the elastic connecting spring being a free end of the cantilever.

* * * * *